United States Patent [19]

Bron et al.

[11] 3,953,695

[45] Apr. 27, 1976

[54] HEAVY CURRENT SWITCH

[76] Inventors: Osip Borisovich Bron, Michurinskaya ulitsa 1, kv. 35; Valentin Danilovich Molchanov, Piskarvesky prospekt, 19, kv. 66, both of Leningrad; Lev Notovich Shifrin, ulitsa Zelenodolskaya 17, korpus 3, kv. 31, Moscow; Adolf Rudolfovich Freivald, prospekt Veteranov 25, kv. 62, Leningrad, all of U.S.S.R.

[22] Filed: July 26, 1973

[21] Appl. No.: 383,304

[52] U.S. Cl. ..... 200/150 C; 200/277; 200/289

[51] Int. Cl.[2] ..... H01H 33/68; H01H 9/52

[58] Field of Search ..... 200/150 R, 150 C, 148 H, 200/67 AA, 277, 289

[56] References Cited

UNITED STATES PATENTS

| | | | |
|---|---|---|---|
| 2,818,479 | 12/1957 | Volk | 200/67 AA |
| 2,988,605 | 6/1961 | Van Gent | 200/277 |
| 3,024,334 | 3/1962 | Rhodes | 200/277 |
| 3,244,833 | 4/1966 | Gillett et al. | 200/289 |

FOREIGN PATENTS OR APPLICATIONS

| | | | |
|---|---|---|---|
| 1,163,938 | 2/1964 | Germany | 200/289 |
| 534,828 | 3/1941 | United Kingdom | 200/148 H |

*Primary Examiner*—Robert S. Macon
*Attorney, Agent, or Firm*—Haseltine, Lake & Waters

[57] ABSTRACT

A heavy current switch comprising two stationary contacts, each consisting of two parts which form, upon being joined together, inter-contact spaces between which there is a movable contact system with two groups of contact rollers which either close or break said inter-contact spaces and which are arranged at diametrically opposite sides of the movable contact system.

The stationary contacts are either arranged parallel to each other or made as semicylinders enveloping the movable contact system.

2 Claims, 10 Drawing Figures

HEAVY CURRENT SWITCH

The present invention relates to a switch for a heavy low voltage current, for instance, for an electrolyzer in chemical industry, and more particularly to a heavy current switch which can also be used in over-voltage installations. By a heavy current is meant a direct or alternating current from 2,000 to more than 100,000A at a voltage from 4 to 500 V..

Known is a heavy current switch comprising four switches connected in parallel, with stationary main contacts and movable roller contacts. It is large in size, has a sophisticated operating mechanism and is not protected from chemically aggressive media.

Also known is a heavy current switch comprising four or more independent switches connected in parallel and placed in an oil tank. It is marked by a big weight and size.

Another known heavy current switch comprises stationary main contacts, made as flat buses and forming two intercontact spaces, and two movable contact systems with roller contacts placed on both sides of the stationary contacts. These are mounted on two parallel shafts. The above structure of the switch makes in possible to reduce the dimensions thereof, as compared to conventional heavy current switches, since it actually replaces two prior-art switches. However, this structure, too, has big dimensions and a sophisticated operating mechanism.

Still another known heavy current switch, design for switching off heavy currents, has an oil protection system, two stationary contacts and a movable contact system made as a bridging conductor. The ends of the stationary contacts are chamfered, as are those of the movable roller contacts; this reduces mechanical stresses which otherwise are strongly felt in similar devices in the course of switching. This type of switch, however, like those mentioned above, has a number of disadvantages, including a big weight and size, low electrodynamic stability and substantial heat losses which are due, in particular, to a considerable length of the bridging conductors.

Thus, the known switches have a number of disadvantages which are the most pronounced in the case of very heavy currents. These disadvantages are as follows: the big weight and dimensions, sophisticated operating mechanisms, inadequate electrodynamic stability and insufficient operational stability of the contact system.

It is an object of the present invention to eliminate the above disadvantages.

The invention aims at providing a heavy current switch wherein the contact in the closed circuit condition is stable and reliable.

The object of the present invention is attained by placing a movable contact system between stationary contacts, which form at least two inter-contact spaces, and mounting it on a shaft secured at the base of the switch, as well as by placing at least two groups of roller contacts on diametrically opposite sides of the movable contact system.

It is expedient that the stationary contacts, between which the movable contact system is found, be arranged parallel to one another.

In addition, the stationary contacts may be made as semicylinders enveloping the movable contact system; inside these semicylinders, there may be water cooling channels, whereas the space between the stationary contacts may be filled with oil.

The arrangement of movable roller contacts between the stationary ones, which form inter-contact spaces, makes it possible to substantially reduce the dimensions of the switch and simplify the operating mechanism thereof. At the same time, the use of parallel stationary contacts permits of considerably increasing the rated currents of the installation. The utilization of stationary contacts made as parallel flat buses substantially simplifies the manufacturing of the switch and makes it possible to do without expensive cast parts.

The use of stationary contacts made as parallel flat buses simplifies assembly thereof, expecially in the case of heavy currents, and enables the installation to be connected directly to straight bus conductors, without altering their general configuration.

The use of combined water and oil cooling, with water utilized both for cooling the current-carrying parts and the oil itself, makes for a sharp increase in the current load of the installation. Oil protects heavy current switches from corrosion and also transfers heat from contacts that are not cooled by water to parts provided with water cooling.

The configuration of water-cooled stationary contacts is adapted for the most effective cooling of the volume of oil wherein movable contacts that are not cooled by water are found. For this purpose, the stationary contacts are made in the form of hollow semicylinders with water passing through them.

The use of a plurality of parallel-connected movable roller contacts ensures reliable multiple-spot connection which is indispensable for heavy current switches.

The switch is made up by several units, each comprising several pairs of rollers. Parallel connection of identical units makes it possible to have switches meant for different rated currents, but consisting of identical parts, which substantially facilitates the manufacturing thereof.

Electrolysis shops at chemical plants, where electrolizers are connected in series, face the necessity of switching off one or even a group of these for recharging or repair. Used for the purpose are heavy current switches which are connected in parallel with an electrolizer or a group of electrolisers being recharged. The proposed heavy current switch with water cooling is best suited for the purpose. It is marked by a small weight and dimensions and shows good operating characteristics with very heavy rated currents of up to and above 100,000 A. Oil reliably protects it from destrictive effects of chemically aggressive media; it is easy to service and may have either manual or pneumatic control.

The heavy current switch is provided with a device which rules out accidental switching on or off. The use of arcing contacts in an oil medium makes it possible to employ the switch for switching off heavy currents in shunting a group of electrolisers. The heavy current switch may also be used with advantage for switching off both direct and alternating currents in metallurgy. Substantial difficulties in the realization of heavy current switches for alternating current are due to a substantially manifest skin effect which raises energy losses and the temperature of current-carrying parts. The use of combined water and oil cooling effectively minimizes these losses and makes for a heavy current switch of a small size, meant for very heavy rated alternating currents.

The invention will now be explained in greater detail with reference to an example of an embodiment thereof taken in conjunction with the accompanying drawings, wherein.

Heavy current switches with water cooling and oil protection from aggressive media may be made with a vertical and horizontal arrangement of the main shaft thereof.

Consider now a heavy current switch with water cooling and a vertical arrangement of the main shaft thereof.

Figure 1:
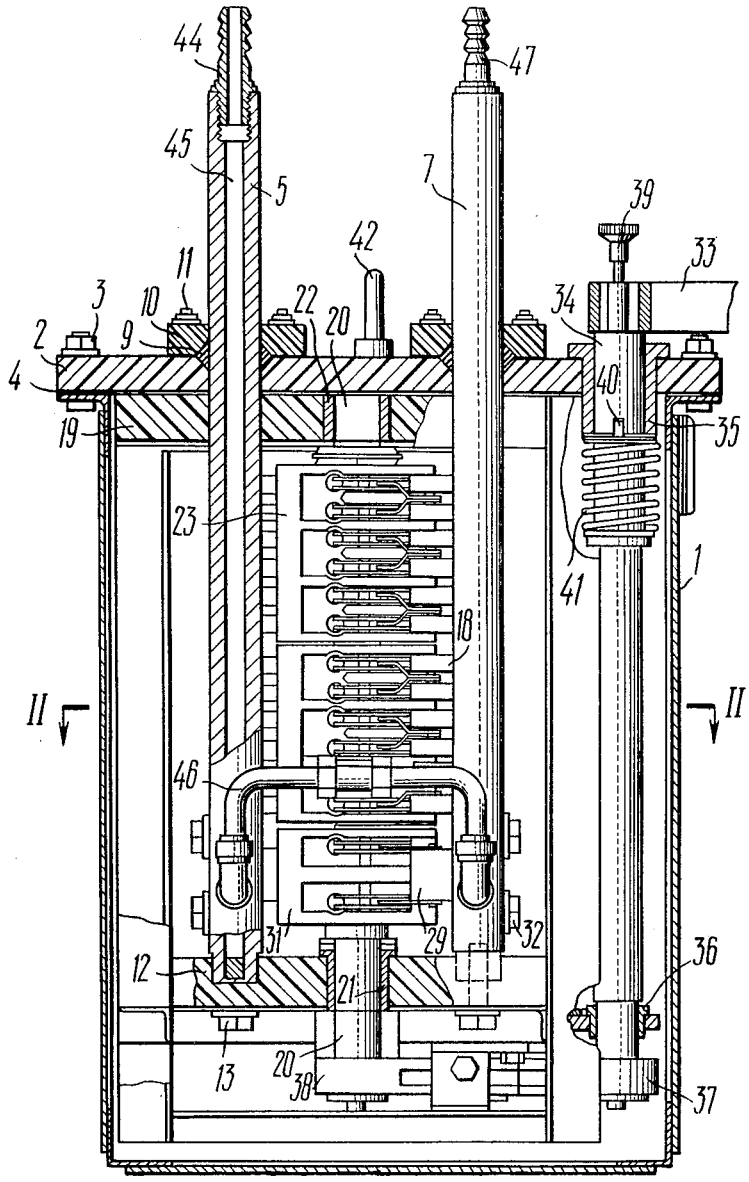
FIG. 1 is a longitudinal sectional view of a heavy current switch with water cooling and a vertical arrangement of the main shaft, according to the invention.

The heavy current switch (FIGS. 1 and 2) comprises an oil-filled tank 1 made of sheet steel and provided with a massive sealing lid 2 which is secured by means of bolts 3 to the upper part of the oil tank 1. Between the lid 2 and the upper part of the oil tank 1, there is a sealing gasket 4. All the outer current-carrying parts of the heavy current switch are coated with acid-proof paint.

Stationary contacts (leads) 5, 6, 7 and 8 (FIG. 3) are four hollow water-cooled buses. The stationary contacts 5, 6, 7 and 8 are arranged vertically and pass through the lid 2 of the oil tank 1. In order to exclude ingress of moisture into the tank 1, a sheet of sealing rubber 9 (FIG. 1) is inserted between the stationary contacts 5, 6, 7 and 8 and the lid 2 and is kept close against them by means of straps 10 and bolts 11. The lower ends of the stationary contacts 5, 6, 7 and 8 are inserted in grooves of an insulation plate 12 and secured to it by means of bolts 13. The insulation plate 12 (FIG. 3) is fastened with the aid of bolts 14 to a metal frame 15 which is fastened by means of bolts 16 to the lid 2.

The stationary contacts 5, 6, 7 and 8 (FIG. 2) are chamfered and arranged so as to form two inter-contact spaces 17, into which movable roller contacts 17 can roll, thus closing or breaking the circuit.

Passing through the insulation plate 12 and an insulation plate 19 (FIG. 1) is a main shaft 20 which rotates in bushes 21 and 22 and is perpendicular to the lid 2 of the tank 1. Rigidly fixed to the main shaft 20 is an insulation base 23 (FIGS. 1 and 2) of the movable contact system. The movable contact system comprises springs 24 arranged in grooves of the insulation base 23, whose force is transmitted via levers 25 and 26 secured upon the insulation base 23 to main movable contact rollers 18. The upper limit of the travel of the contact rollers 18 is set by pins 27 passing through a hole in the lever 25, the other end of the lever 25 rotating around an axle 28. The contact rollers 18 are placed at diametrically opposite sides of the insulation base 23. The number of parallel-connected contact rollers 18 depends upon a value of the current. In order to reduce the transient resistance of the contacts, both the stationary and the movable contacts are furnished with silver building-ups (not shown).

Figure 2:
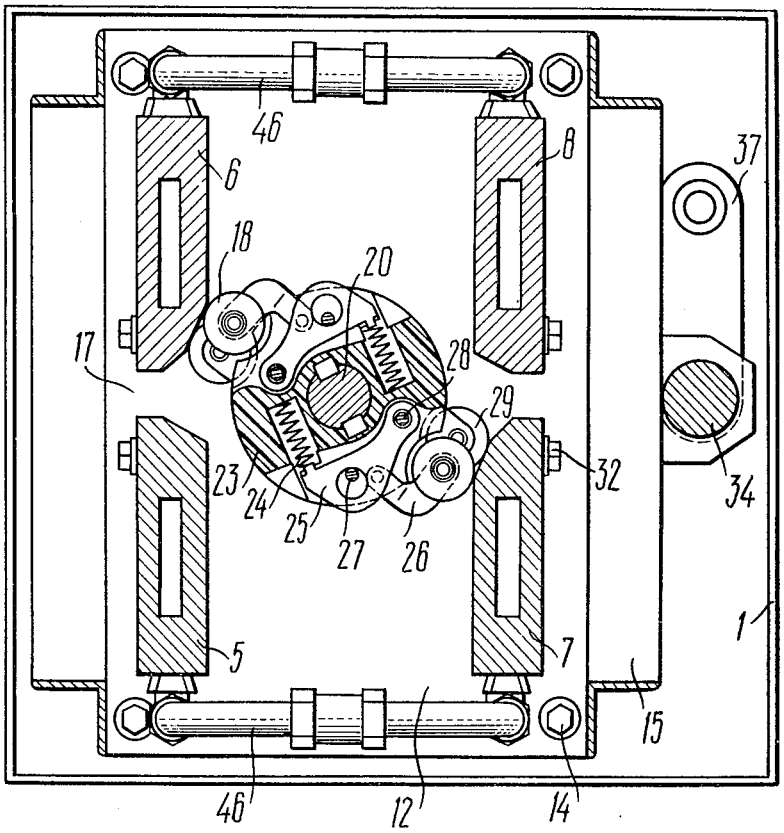
FIG. 2 is a sectional view of line II—II of FIG. 1.
Figure 3:
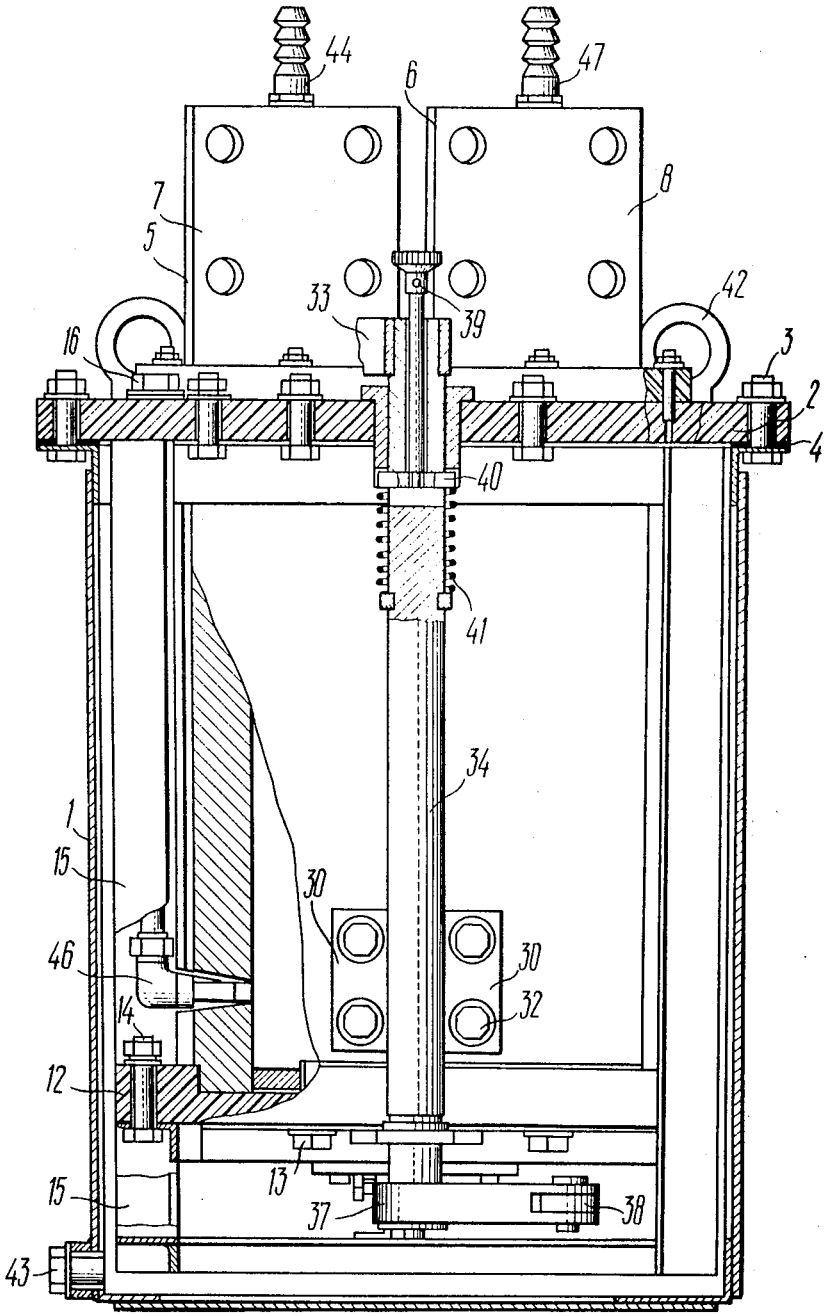
FIG. 3 is a side view of a heavy current switch of FIG. 1.

The contact rollers 18 and the stationary contacts 5, 6, 7 and 8 are protected from burning by arcing contacts 29 and 30 (FIGS. 2 and 3). The arcing contacts 29 are in the form of rollers and are arranged upon an insulation base 31 (FIG. 1) rigidly fixed to the main shaft 20 which is of the same form as the base 23 of the movable contact system. The arcing contacts are rigidly fastened by means of bolts 32 to the stationary contacts 5, 6, 7 and 8 and can be easily replaced if burned.

The heavy current switch is provided with a hand drive. The drive comrpises a handle 33 (FIGS. 1 and 3) which is mounted upon a drive shaft 34. From the handle 33, an effort is transmitted to the drive shaft 34 which rotates in a bush 35 mounted on the lid 2 and in a bush 36 mounted on the metal frame 15, and further on, via levers 37 and 38, to the main shaft 20.

In order to rule out accidental switching on or off, the drive shaft 34 is mounted by a locking device which comprises a rod 39 screwed into a sliding block 40 which is lifted by a spring 41 fitted over the drive shaft 34.

For hoisting and transporting the heavy current switch, provision is made for eye bolts 42 mounted on the lid 2 and fastened to the metal frame 15. To fill the oil tank 1 with oil, there is a cork (not shown) in the lid 2; to drain off oil and empty the oil tank 1, there is a cork 43 at the bottom of the oil tank 1.

Consider now the operation of the heavy current switch.

To switch on the heavy current switch, one has to press the rod 39 of the drive and turn the handle 33. This makes the drive shaft 34 rotate; the latter's rotation is transmitted via the levers 37 and 38 to the main shaft 20. A rotation of the main shaft 20 results in that of the insulation bases 23 and 31 rigidly fixed to it, mounted whereon are the contact rollers 18 and the arcing contacts 29. These roll along the inner surface of the stationary contacts 5, 6, 7 and 8 and roll into the inter-contact spaces 17. A rotation of the main shaft 20 makes the arcing contacts 29 come into contact with the arcing contacts 30 at a moment when the main movable contact rollers 18 have not yet rolled into the inter-contact spaces 17. Further rotation of the main shaft 20 compresses the spring 24 and makes the movable contact rollers 18 roll into the inter-contact spaces 17. At the moment of the complete switching on of the heavy current switch, the lever 26 of the arcing contact 29 is past the dead center, and the spring 24 is somewhat slackened.

A complete switching on of the heavy current switch actuates the locking device which prevents accidental switching off; the sliding block 40 gets into the groove of the bush 35 and locks the drive shaft 34. As the heavy current switch is switched off, one has to press the rod 39 which disengages the sliding block 40 from the bush 35 and frees the drive shaft 34. As the handle 33 is turned in the opposite direction, rotation of the drive shaft 34 is transmitted via the system of the levers 37 and 38 to the main shaft 20 which turns the insulation bases 23 and 31; this makes the movable contact rollers 18 roll out from the intercontact spaces 17; then the arcing contacts 29 roll out, thus breaking the circuit.

In order to raise current loads of the current-carrying parts of the heavy current switch, provision is made for water cooling. Water is supplied to pipe connections 44 (FIGS. 1 and 3) mounted on the stationary contacts 5 and 6; then it is fed via channels 45 to pipes 46 made of an insulation material and further proceeds through channels of the stationary contacts 7 and 8 to the pipe connections and outside.

Consider now another embodiment of the heavy current switch with water cooling and a horizontal arrangement of the main shaft.

Figure 4:
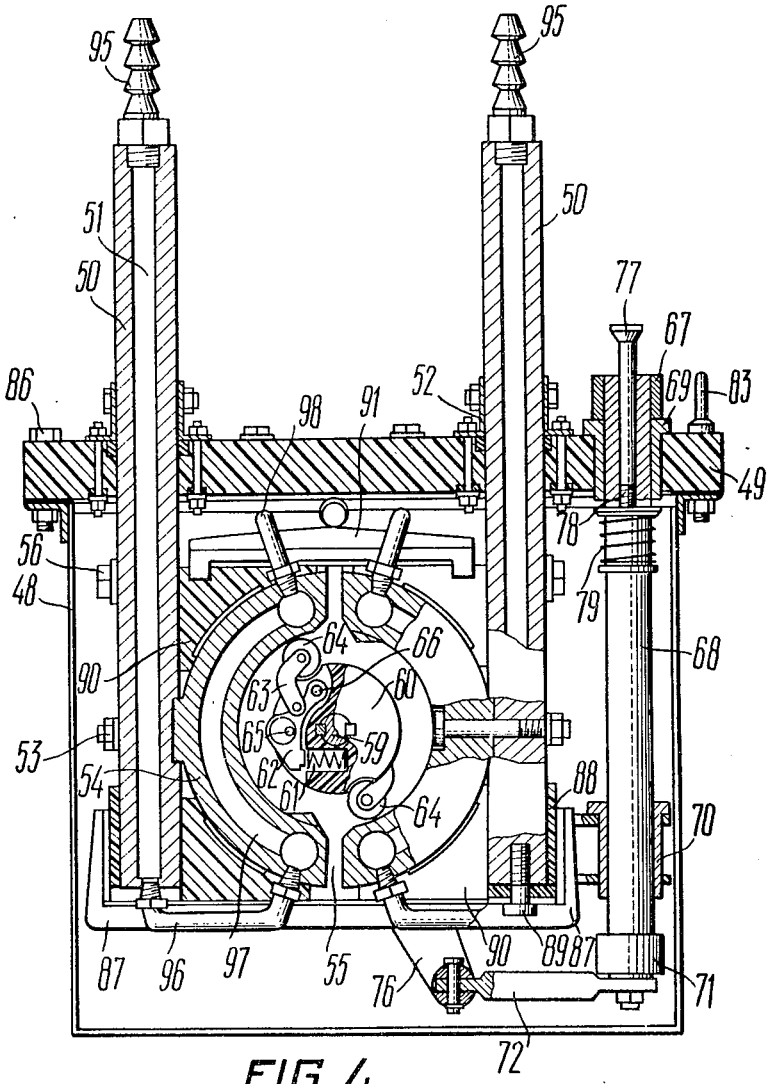
FIG. 4 is a cross-section of a heavy current switch with water cooling and a horizontal arrangement of the main shaft.

The heavy current switch (FIGS. 4 and 5) comprises a tank 48 filled with oil and provided with a sealing lid 49.

Leads 50 with water cooling channels 51 are passed through the sealing lid 49 whereto they are fastened by means of angles 52.

Fixed to the leads 50 by means of bolts 53 are two stationary contacts 54 which are shaped as semicylinders facing each other and form two inter-contact spaces 55. Fastened by means of bolts 56 (FIG. 5) to the sealing lid 49 of the heavy current switch are two insulation supports 57, passed through which is a main shaft 59 of the heavy current switch; the main shaft 59 rotates in bearings 58 and is arranged parallel to the lid 49. Rigidly fixed to the main shaft 59 (FIG. 4) is an insulation base 60 of a movable contact system. The movable contact system comprises springs 61 arranged in grooves of the insulation base 60, whose effort is transmitted via levers 62 and 63 mounted upon the insulation base 60 to movable contact rollers 64. The upper limit of the travel of the movable contact rollers 64 is set by pins 65 passed through a hole in the lever 62, whereas the other end of the lever 62 rotates around an axle 66.

The movable contact rollers 64 are arranged at diametrically opposite ends of the insulation base 60. The number of such parallel-connected movable contact rollers 64 depends upon a value of the current. As the main shaft 59 rotates, the movable contact rollers 64 roll into the spaces 55 between the stationary contacts 54 and complete the circuit.

Figure 5:
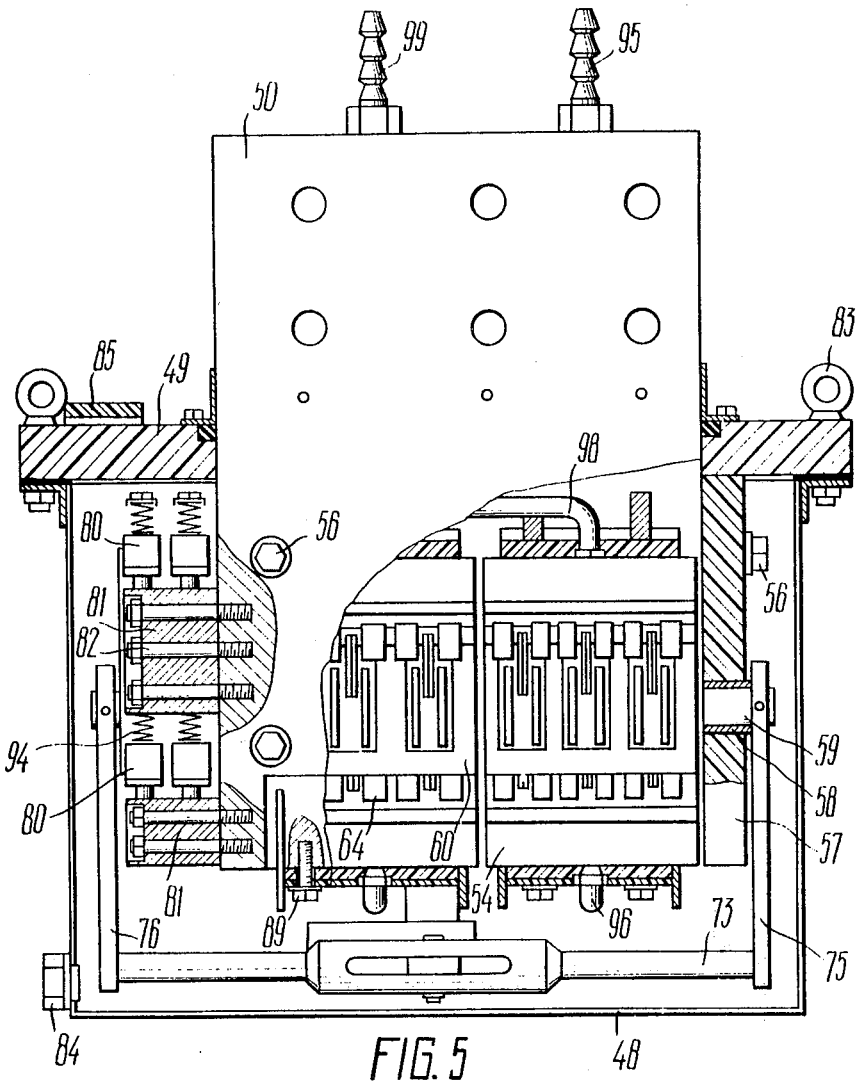
FIG. 5 is a longitudinal sectional view of a heavy current switch of FIG. 4.
Figure 6:
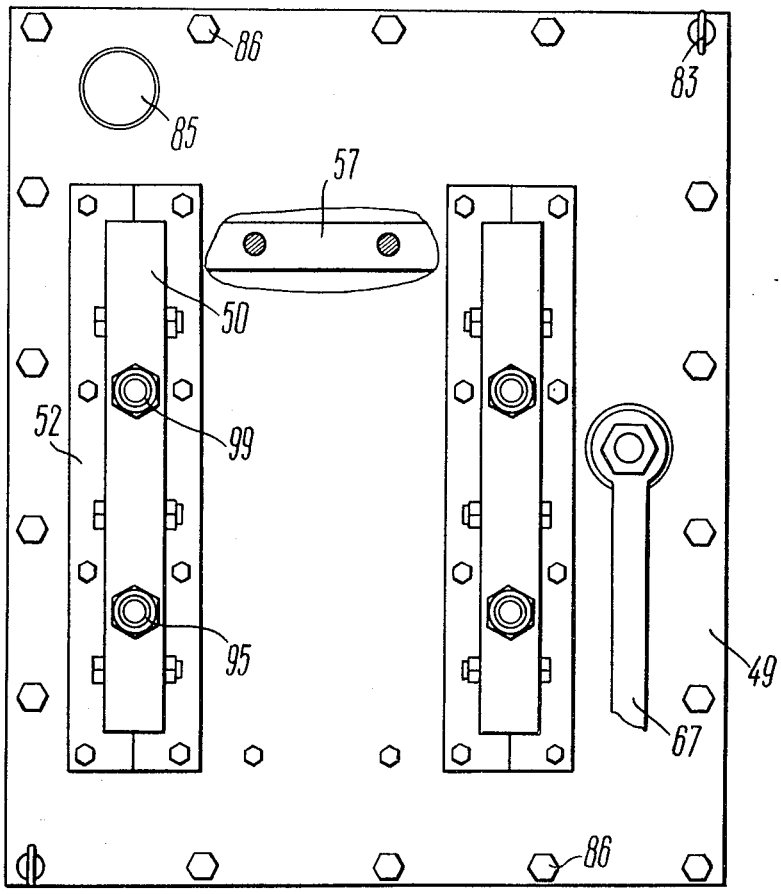
FIG. 6 shows a lid of a heavy current switch.

The heavy current switch has a hand drive. It comprises a handle 67 mounted upon a drive shaft 68. From the handle 67, an effort is transmitted to the drive shaft 68 which rotates in bushes 69 and 70 and further on, via levers 71 and 72, to an axle 73 (FIG. 5). The levers 71 and 72 are connected by means of a globe joint (FIG. 6), which gives some play to the lever 72. The axle 73 is hinged to levers 75 and 76 (FIG. 5) which transmit rotation to the main shaft 59 of the heavy current switch.

To rule out accidental switching on or off, the drive shaft 68 is provided with a locking device which comprises a rod 77 (FIGS. 4 and 6) screwed into a sliding block 78 which is lifted by a spring 79 fitted over the shaft 68.

Figure 7:
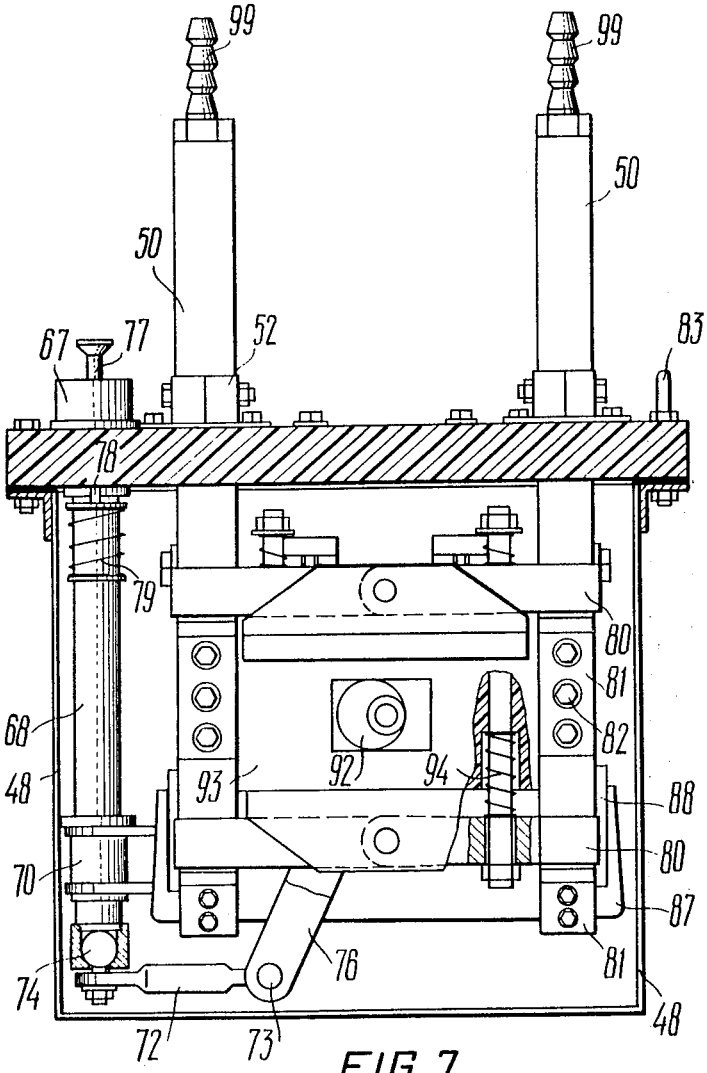
FIG. 7 shows break contacts.

In order to protect the movable contact rollers 64 and the stationary contacts 54 from burning, provision is made for arcing contacts 80 and 81 (FIGS. 5 and 7), the arcing contacts 80 being made movable, whereas the arcing contacts 81 are fastened by bolts 82 to the leads 50 and can be easily replaced. For hoisting and transporting the heavy current switch, provision is made for eye bolts 83 arranged upon the lid 49. To change oil or empty the tank 48, there is a cork 84; to fill the tank 48 with oil, there is a cork 85 (FIG. 7) in the lid 49. The lid 49 is fastened to the tank 48 by means of bolts 86.

For greater rigidity of the entire system, the leads 50 (FIG. 4) are interconnected by steel clamps 87. The clamps 87 with seal courses 88 are secured by means of bolts 89 to the leads 50. To exclude deformation of the stationary contacts 54 following a switching on of the heavy current switch, provision is made for elastic packings 90 between the leads 50 and the stationary contacts 54, which are held up tight by clamps 91 and the clamps 87.

Consider now operation of the above heavy current switch. To switch it on, one has to press the rod 77 and turn the handle 67 of the drive. This turns the drive shaft 68, rotation being transmitted via the levers 71 and 72, the axle 73 and the levers 75 and 76 to the main shaft 59. Rotation of the main shaft 59 results in that of the insulation base 60 rigidly connected to it and mounted by the movable contact rollers 64. These start rolling along the inner cylindrical surface of the stationary contacts 54 and roll into the inter-contact spaces 55 between the stationary contacts 54. Simultaneously, rotation of the main shaft 59 results in that of a cam 92 mounted upon it, which transmits rotation via an insulation base 93 to the movable arcing contacts 80 and brings them into contact with the stationary arcing contacts 81.

The arrangement of all movable parts upon the main shaft 59 is such that as it rotates, the arcing contacts 80 are brought into contact with the contacts 81 before the movable contact rollers 64 have rolled into the inter-contact spaces 55. Further rotation of the main shaft 59 compresses a spring 94 which presses with a greater force upon the arcing contacts 80; as a result, the contact rollers 64 roll into the inter-contact spaces 55.

At the moment the heavy current switch is fully switched on, a locking device operates which rules out the heavy current switch being accidentally switched off. As this takes place, the sliding block 78 gets into the groove of the bush 69 and locks the drive shaft 68. To switch off the heavy current switch, one has to press the rod 77 which disengages the sliding block 78 from the bush 69 and frees the drive shaft 68. Turning the handle 67 in the opposite direction transmits rotation from the drive shaft 68 via the system of the levers 71, 72, 75 and 76 to the main shaft 59 which rotates the insulation base 60; as a result, the movable contact rollers 64 roll out from the inter-contact spaces 55; after that arcing contacts 80 and 81 are driven apart and the circuit is broken.

In order to raise current loading of the current-carrying components of the heavy current switch, provision is made for water cooling. Water is supplied to a pipe connection 95 mounted upon the leads 50; then water is fed via the channels 51 in the leads 50 to a pipe 96 and to channels 97 of the stationary contacts 64 which consist of two parts joined together by a pipe 98. After passing through both parts of the stationary contacts 64, water is fed to a pipe connection 99, whereto water mains are connected.

In most water-cooled heavy current switches, the movable contacts are heated up the most. This is due to difficulties involved in supplying water to movable components; as a result, movable contacts are left without water cooling. In such systems, a rated current of the heavy current switch is limited by a temperature of the movable contacts thereof. This necessitates searching for new ways of cooling these contacts. One such way consists in using oil to transfer heat from the movable contacts to the stationary ones which are water-cooled. Yet in order to make such transfer effective, provision has to be made for intensive cooling of the oil itself in an area where the movable contacts are found.

This is precisely what has been attained in the proposed system through the use of the water-cooled stationary contacts 54 which envolope the entire area where the movable contacts are found that are made as the movable contact rollers 64.

In the system described herein, the heat flux is directed from the movable contact rollers 64 to the oil and from the latter, to the water-cooled stationary contacts 54.

Figure 8:
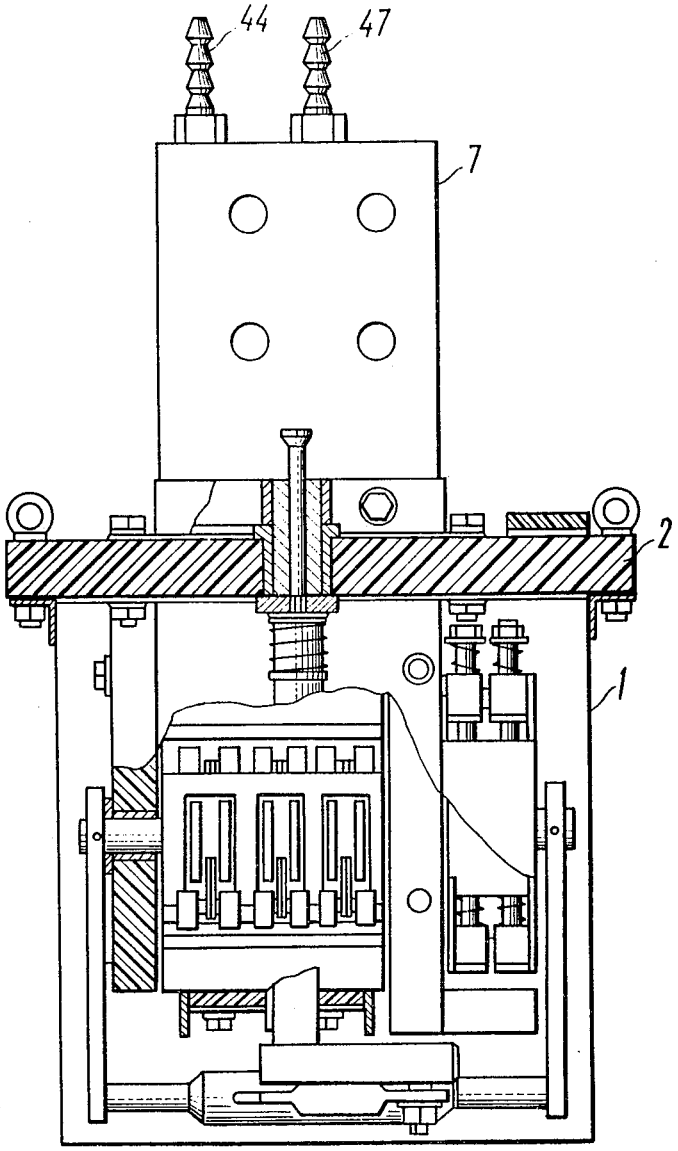
FIGS. 8, 9, 10 show heavy current switches for rated currents of 25, 50 and 100 kA.
Figure 9:
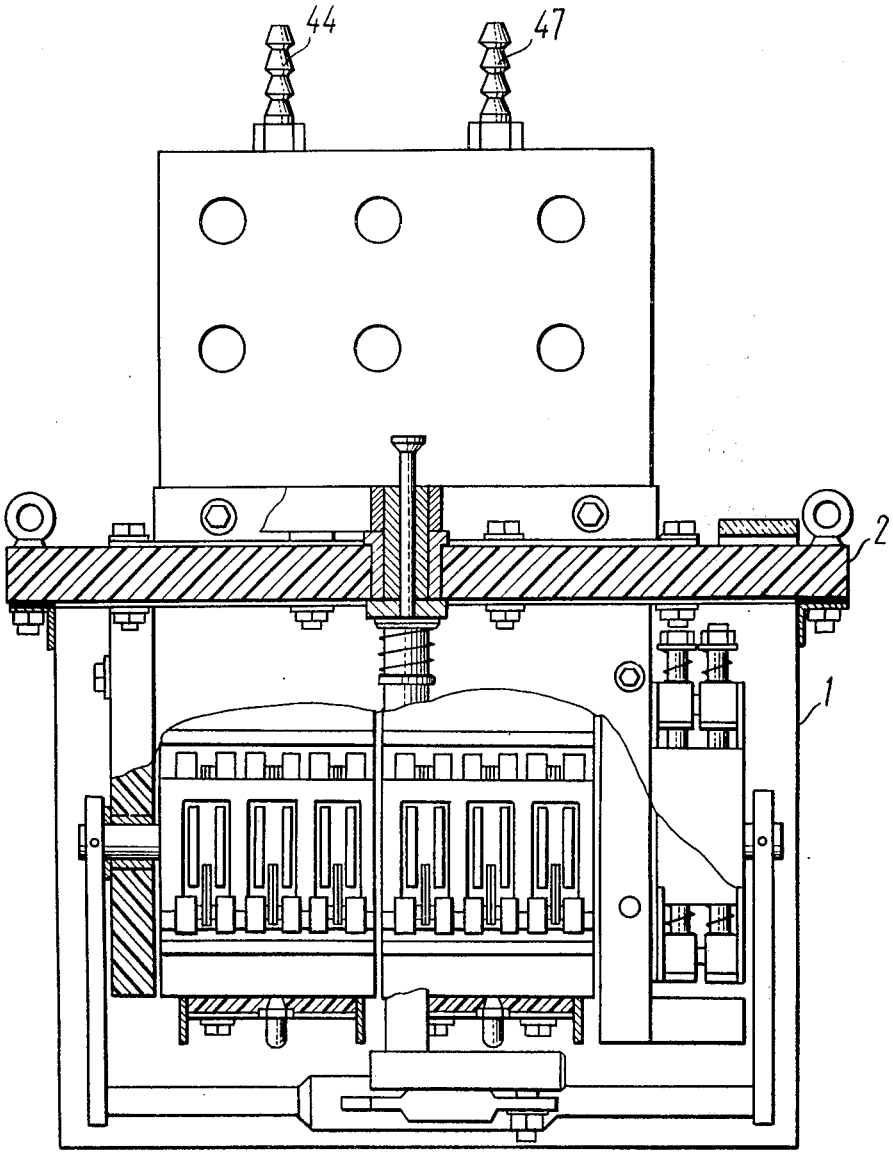
Figure 10:
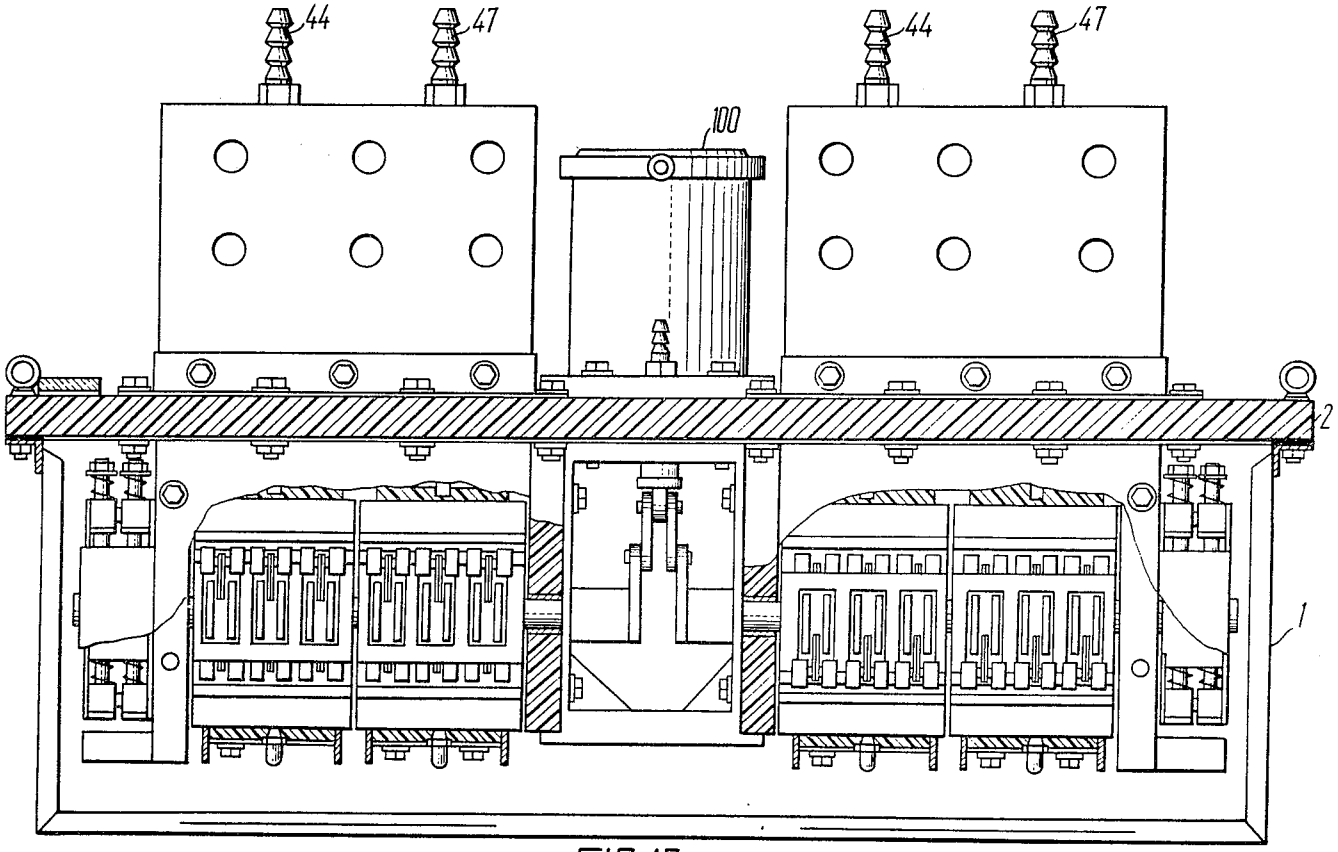

FIGS. 8, 9 and 10 show a series of heavy current switches with oil protection from aggressive media, designed for currents of 25, 50 and 100 kA.

The heavy current switch for 25 kA (FIG. 8) comprises one pair of stationary contacts, whereas the heavy current switch for 50 kA (FIG. 9) comprises two pairs of stationary contacts, as is shown in FIGS. 4, 5, 6 and 7, reference numeral 54.

The heavy current switch for 100 kA (FIG. 10) consists of two halves, each being designed for 50 kA. In order to overcome great efforts in the course of switching on, the lid of the heavy current switch is mounted by a pneumatic cylinder 100.

What is claimed is:

1. A heavy current switch comprising two stationary contact systems made in the form of half-cylinders facing each other and having water-cooling channels, said systems forming two inter-contact gaps; a base supporting said contact systems; a shaft coupled with said base; a movable contact system secured on said shaft in the cylindrical space defined by said stationary contact systems and carrying two groups of insulated contact rollers arranged at the opposite sides of said movable contact system and closing or breaking the inter-contact gaps between the stationary contact systems.

2. A heavy current switch as claimed in claim 1, wherein the space between the stationary contact systems and the movable contact system is filled with oil.

* * * * *